United States Patent [19]

Stenemann

[11] Patent Number: 4,842,349

[45] Date of Patent: Jun. 27, 1989

[54] DISPLAY COUNTER

[75] Inventor: Bruno Stenemann, Beckum, Fed. Rep. of Germany

[73] Assignee: Gerd Und Bernd Vieler KG, Iserlohn, Fed. Rep. of Germany

[21] Appl. No.: 103,177

[22] Filed: Sep. 30, 1987

[30] Foreign Application Priority Data

Oct. 11, 1986 [DE] Fed. Rep. of Germany ..... 3634684

[51] Int. Cl.[4] ..... A47F 3/04

[52] U.S. Cl. ..... 312/116; 49/340; 312/139; 312/296; 312/328

[58] Field of Search ..... 312/116, 24, 138 R, 312/139, 138 A, 287, 295, 296, 319, 328, 325; 49/383, 381, 340

[56] References Cited

U.S. PATENT DOCUMENTS

| | | | |
|---|---|---|---|
| 681,624 | 8/1901 | Cowles | 49/340 X |
| 3,238,573 | 3/1966 | Pease, Jr. | 49/383 |
| 3,539,238 | 11/1970 | Kruspe et al. | 312/139 X |
| 4,496,201 | 1/1985 | Allgeyer | 312/138 R |

FOREIGN PATENT DOCUMENTS

| | | | |
|---|---|---|---|
| 148581 | 9/1936 | Austria | 49/383 |
| 7504892 | 6/1975 | Fed. Rep. of Germany . | |
| 3235371 | 3/1984 | Fed. Rep. of Germany | 312/116 |
| 3313914 | 10/1984 | Fed. Rep. of Germany | 312/139 |
| 3503340 | 8/1986 | Fed. Rep. of Germany | 312/116 |
| 96216 | 4/1960 | Sweden | 49/383 |

*Primary Examiner*—Peter A. Aschenbrenner
*Assistant Examiner*—Thomas A. Rendos
*Attorney, Agent, or Firm*—Peter K. Kontler

[57] ABSTRACT

A display counter for use in supermarkets and like establishments for temporary storage, cooling and displaying of foodstuffs has a case with a hollow upper section having a pivotable front panel at the customer side and a horizontal counter top. The front panel can be pivoted by one or more fluid-operated motors with assistance from an attendant and through the medium of hinges which are mounted on forwardly extending arms of the skeleton frame of the upper section of the case. The top marginal portion of the front panel is held between discrete or integra rails of the hinges so that its exposed side is normally flush with the upper side of the counter top. One of the rails has a portion which extends rearwardly and overlies the adjacent portions of the arms and of the counter top to seal the interior of the case from the surrounding atmosphere when the front panel is held in its operative position at the customer side of the counter. An attendant can assist the motor or motors to pivot the front panel to a raised position in which the interior of the upper section of the case is accessible at the customer side for restocking and/or cleaning.

13 Claims, 6 Drawing Sheets

FIG. 8
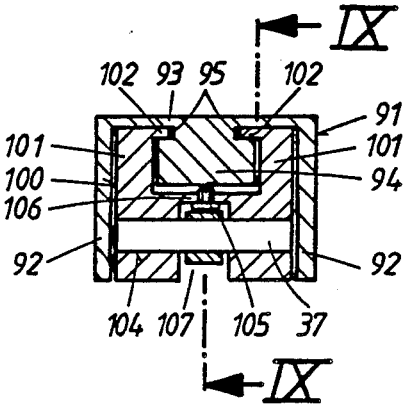
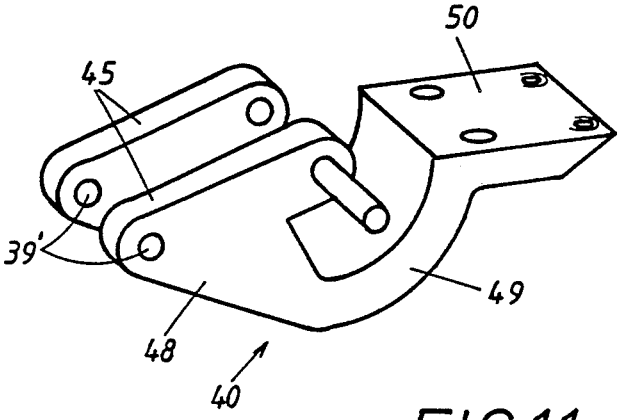
FIG.11

DISPLAY COUNTER

BACKGROUND OF THE INVENTION

The invention relates to pieces of furniture in general, and more particularly to improvements in display counters of the type used in supermarkets, butcher shops, pastry shops and similar establishments to cool and display foodstuffs and/or other commodities for the benefit of shoppers and/or browsers. More particularly, the invention relates to improvements in display counters of the type wherein a case has a lower section supporting an at least partially hollow upper section which has a front or customer side and a rear or service side. The upper section has a first panel which can be called a counter top and a second panel which is preferably a panoramic window and is disposed at the customer side to allow for observation of goods in the interior of the case. As a rule, the second panel is pivotable about a horizontal axis so that it affords access to the interior of the upper section of the case from the customer side, e.g., in order to facilitate refilling of the counter with goods and/or to facilitate cleaning of the interior of the hollow upper section.

It is known to mount the second panel of the hollow upper section of the case for pivotal movement about a horizontal axis defined by hinges at the front ends of horizontal arms which form part of the skeleton frame of the upper section of the case and extend forwardly from the service side toward the customer side. The first panel rests on the arms and the second panel is pivotable to and from a raised position in which it can afford access to the interior of the upper section of the case from the customer side. It is also known to employ a prime mover, particularly a fluid-operated motor, which can be actuated to move, or to facilitate manual movement of, the second panel to its raised position As a rule, the motor is a pneumatic cylinder and piston unit. One end portion of the cylinder and piston unit is articulately connected to the arm, and the other end portion of such unit is articulately connected to the hinge which pivotably secured the second panel to the front end portion of the arm.

A display counter of the aboveoutlined type is described in German Utility Model No. 75 04 892.9. The hinge which connects the upper marginal portion of the second panel of the upper section of the case to its arm is located at a level beneath the arm. When the second panel is maintained in its normal or operative position (in which it closes the upper section of the case at the customer side), the rail which is connected to the hinge and engages the adjacent marginal portion of the second panel is located below the arm and is disposed between the pintle of the hinge and the locus of pivotal connection of the cylinder and piston unit to the hinge. In such position of the second panel, the latter defines with the arm a clearance or gap which cannot be sealed, even in the operative position of the second panel, because such gap renders it possible to pivot the second panel between its operative and raised positions. The presence of a clearance between the front end portion of the arm and the upper marginal portion of the second panel is highly undesirable, even though it must be tolerated in conventional display counters, because the clearance allows for rapid contamination of the interior of the hollow upper section of the case and raises the energy requirements of the cooling system for foodstuffs in the interior of the case.

Another drawback of heretofore known display counters of the above outlined character is that the second panel must be maintained in the raised or inoperative position by specially designed locking or retaining means so as to prevent accidental lowering while an attendant is in the process of removing commodities from the case, of refilling the case with fresh commodities or of cleaning the interior of the case. Still further, the aforementioned cylinder and piston unit does not suffice to appreciably reduce the effort which is required to pivot the second panel to its raised position.

OBJECTS AND SUMMARY OF THE INVENTION

An object of the invention is to provide a display counter which is constructed and assembled in such a way that the upper section of the case is reliably sealed from the surrounding atmosphere, at least at the customer side, as long as the second panel remains in its operative position Another object of the invention is to provide a display counter wherein the second panel of the upper section of the case can be moved to its inoperative or raised position with a minimum of effort.

A further object of the invention is to provide a display counter wherein the second panel can remain in its raised or inoperative position as long as desired without the need for specially designed locking or retaining means.

An additional object of the invention is to provide novel and improved hinges for connecting the second panel of the upper section of the case to the skeleton frame of the upper section.

Still another object of the invention is to provide novel and improved means for sealing the upper section of the case between the counter top and the second panel while the second panel overlies the customer side of the case.

Another object of the invention is to provide a novel and improved skeleton frame for use in the upper section of the case in the above outlined counter.

A further object of the invention is to provide novel and improved supporting arms for the first panel and hinges of the above outlined display counter.

Another object of the invention is to provide a display counter wherein the seal between the panels of the upper section can stand long periods of use.

Still another object of the invention is to provide a display counter wherein the hinge or hinges between the skeleton frame of the upper section of the case and the second panel can be pivoted by one or more motors.

The invention is embodied in a counter, particularly in an article of furniture which is used for temporary storage, cooling (if necessary) and simultaneous displaying of foodstuffs in supermarkets, pastry shops, butcher shops, delicatessen, restaurants and like establishments. The improved counter comprises a case having a front side which is faced by customers or browsers when the counter is set up in a supermarket or in a like establishment and a service side opposite the front side. The case includes a lower portion and an at least partially hollow upper portion, and the upper portion includes one or more substantially horizontal arms extending forwardly from the service side toward the front side and each having a front end portion at or close to the front side. The counter further comprises a substantially horizontal first panel adapted to serve as a counter top on which the salesperson deposits the purchased commodities and the customers deposit cash, redeemable coupons, checks or other tenders, a preferably panoramic second panel, and a hinge having a first section connected to the second panel, a pintle defining a substantially horizontal pivot axis and provided on the front end portion of the arm, and a preferably at least partially arcuate second section which is pivotable with the first section and with the second panel about the pivot axis between a first position in which the first section is located in front of the arm and the second panel closes the upper section of the case at the front side of the case beneath the arm, and a second position in which the first section is located at a level above the arm and the second panel affords access to the interior of the hollow upper section of the case. One of the sections has a portion which is immediately or very closely adjacent the front end portion of the arm in the first positions of the sections, and the counter preferably further comprises fluid-operated motor means which is or are operative to move (or to assist in the movement of) the sections and second panel between the first and second positions.

The second panel preferably comprises a substantially horizontal elongated marginal first portion which is adjacent the front end portion of the arm, and the first section of the hinge can comprise a pair of horizontal clamping members (e.g., two elongated parallel rails) which flank and engage the marginal portion of the second panel so that the latter is compelled to share the movements of the sections of the hinge about the horizontal pivot axis. Each motor means includes a first portion which is connected to the arm and a second portion which is movable relative to the first portion (the two portions of the motor means can be telescoped into each other) and is connected to one section of the hinge, for example, to the second section. A second portion of the second panel is preferably inclined with reference to the aforementioned marginal first portion and is used to overlie the major part of the front side of the case in the first positions of the first and second sections of the hinge. The second panel can constitute a panoramic window and is preferably connected to the first section of the hinge. The first panel and the front end portion of the arm define a clearance which is overlapped by the aforementioned portion of the one (normally first) section of the hinge, at least in the first positions of the first and second sections.

That end portion of each motor means which is adjacent the horizontal pivot axis is preferably connected to the second section of the hinge by a horizontal fulcrum which is or can be parallel to the pintle and defines for the end portion of the motor means a pivot axis. The second section of the hinge preferably comprises a link which is pivotable about the axes of the pintle and fulcrum, a distancing element which is rigid (for example, integral) with the link, an arcuate intermediate element which is rigid (for example, integral) with the distancing element, and a bracket or platform which is rigid (e.g., integral) with the intermediate element and with the first section of the hinge (e.g., with one of the aforementioned clamping members). The intermediate element is remote from the pintle, and the bracket or platform is located in front of the front end portion of the arm in the first positions of the first and second sections of the hinge. The first or marginal portion of the second panel is preferably located at or close to the level of the first panel in the first positions of the first and second sections of the hinge.

The underside of the front end portion of the arm preferably slopes downwardly from the front said toward the service side of the case, and the counter can further comprise an elongated horizontal rim which overlies the front end portion of the arm and is immediately or very closely adjacent the aforementioned portion of the one section of the hinge. Such rim can overlie a portion of or the entire underside of the front end portion of the arm and can form part of the first panel or of a horizontal frame member which is adjacent the front edge face of the first panel above the arm. Elastic sealing means can be provided at the front end portion of the arm to be engaged by the aforementioned portion of the one section in the first positions of the first and second sections of the hinge so as to seal the aforementioned clearance. The sealing means can include a substantially Z-shaped sealing strip, and the arm and the first panel can be provided with sockets or recesses for portions of the sealing strip.

The arcuate intermediate element of the second section of the hinge can be provided with a concave inner side which faces toward and is spaced apart from the pintle, and a convex outer side which faces away from the pintle. The mutual inclination of the link and distancing element of the second section of the hinge is preferably such that the distancing element is adjacent and parallel to the underside of the front end portion of the arm in the second positions of first and second sections of the hinge.

The arm can have a substantially E-shaped cross-sectional outline with a web and three flanges extending from one side of the web. The pintle is preferably provided in the median flange of such arm. The median flange can further support a bearing for the motor means, e.g., for a fulcrum.

The motor means can include a plurality of discrete cylinder and piston units each of which is connected to the arm at one end and to one section of the hinge at the other end. If the arm has a substantially U-shaped profile, its flanges preferably flank the cylinder and piston units of the motor means The novel features which are considered as characteristic of the invention are set forth in particular in the appended claims. The improved display counter itself, however, both as to its construction and the mode of pivoting its second panel, together with additional features and advantages thereof, will be best understood upon perusal of the following detailed description of certain specific embodiments with reference to the accompanying drawing

BRIEF DESCRIPTION OF THE DRAWING

FIG. 8 is a transverse vertical sectional view of a third embodiment of the display counter showing the arm and certain parts of the hinge;

FIG. 11 is a perspective view of a hinge which can be used in the counter including the structure shown in FIGS. 8 to 10.

DESCRIPTION OF THE PREFERRED EMBODIMENTS

Figure 1:
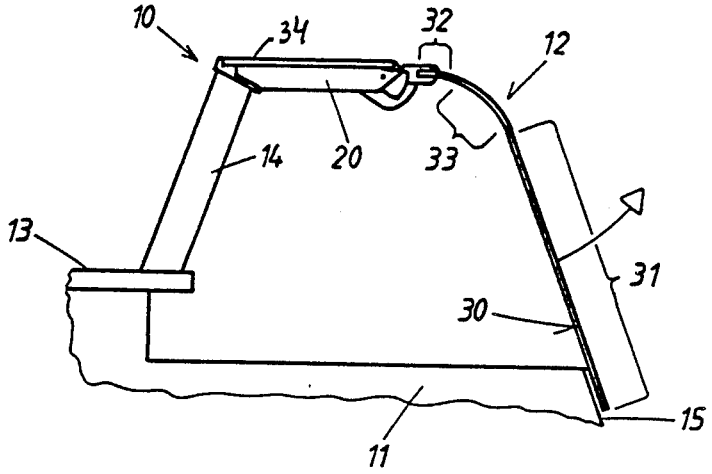
FIG. 1 is a fragmentary schematic side elevational view of a display counter which embodies one form of the invention.

The display counter 10 of FIG. 1 can resemble that which is disclosed in commonly owned copending patent application Ser. No. 826,280 filed Feb. 5, 1986. It comprises a case having a lower section 11 and a hollow upper section 12 on top of the lower section. The attendant or attendants are positioned at the service side of the counter 10 where the latter comprises a table or shelf 13 forming part of the lower section 11 and being located at a level below a set of upwardly and forwardly inclined support members 14 forming part of a skeleton frame of the upper section 12. The latter further comprises a set of two or more horizontal arms 20 each of which is or can be rigid with one of the support members 14 and extends forwardly toward the customer side 15 of the counter 10. Each support member 14 can constitute a profiled metallic beam of the type disclosed in the aforementioned copending patent application Ser. No. 826,280. The front end portions 25 (FIG. 2) of the arms 20 support specially designed hinges 40 for the marginal portion 32 of a panoramic panel 30 which is a light-transmitting window and normally overlies the interior of the hollow upper section 12 at the customer side 15 of the case. The panel 30 further comprises a larger second portion 31 which is integral with and is inclined relative to the marginal portion 32, and an arcuate intermediate portion 33 constituting a junction between the portions 31 and 32. The arcuate intermediate portion 33 can be replaced with an angled intermediate portion without departing from the spirit of the invention.

Figure 2:
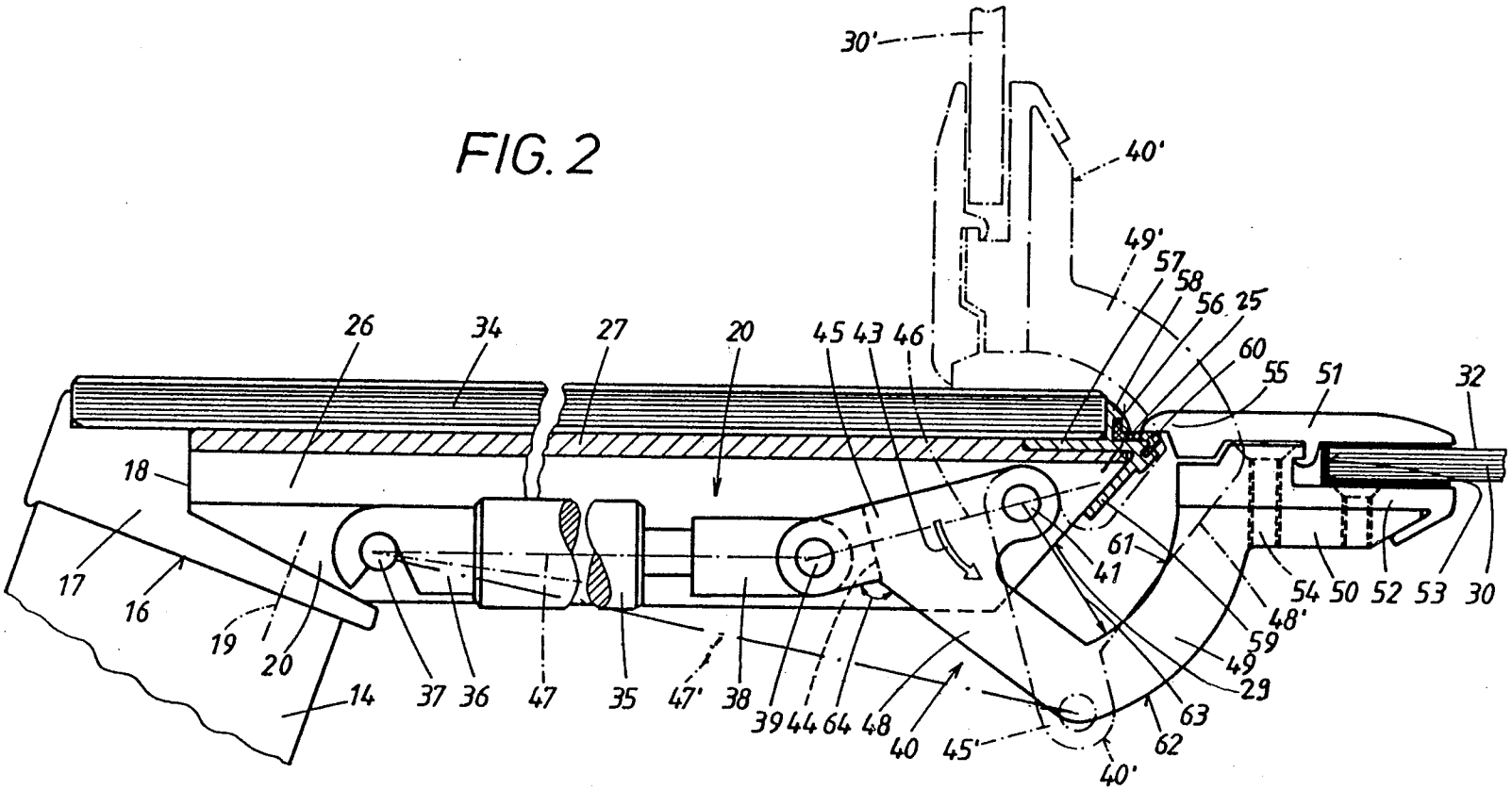
FIG. 2 is an enlarged vertical sectional view of the upper section of the case of the counter of FIG. 1, the first positions of the second panel and one of the hinges being shown by solid lines and the second position of the second panel and of the one hinge being shown by phantom lines.

FIG. 1 merely shows a single arm 20 but the skeleton frame of the upper section 12 normally comprises two or more horizontal arms which support a horizontal panel 34 constituting a counter top and serving as a depository for returned commodities, for freshly purchased commodities as well as for cash, redeemable coupons and/or other tenders which are presented by the purchasers of commodities to the person or persons standing at the customer side of the counter 10. Each arm 20 can have a substantially U-shaped cross-sectional outline (see FIG. 5) with a horizontal web 27 and two depending flanges 21, 22 flanking a fluid-operated motor 35 which is used to facilitate movements of the panel 30 between a first or operative position which is shown in FIG. 1 (and by solid lines in FIG. 2) and a second or raised (inoperative) position which is shown in FIG. 2 by phantom lines, as at 30'. Those portions (23) of the flanges 21, 22 which are immediately adjacent the motor 35 are reinforced (thickened). As shown in FIG. 4, the thickness of the foremost portions 24 of the flanges 21, 22 is reduced and such foremost portions are provided with registering horizontal holes or bores 42 for a pintle 41 forming part of the hinge 40 which articulately connects the marginal portion 32 of the panel 30 to the front end portion 25 of the respective arm 20 for movement between the aforementioned first and second positions. The thickness of the flanges 21, 22 can be reduced (at 24) in a suitable milling machine or in another machine tool. Such machine tool can be used to convert an elongated blank having a rectangular profile into a series of discrete arms 20 each having a web 27 and two flanges 21, 22 with reinforced or thickened portions 23 so that the arms 20 can readily support the weight of the panels 30 and 34, of the hinges 40 and of the fluid-operated motor or motors 35. The pivot axis which is defined by the pintle 41 of the hinge 40 shown in FIGS. 2, 3, 4 and 7 is horizontal and is parallel to the elongated marginal portion 32 of the pane 30. The motor 35 can move the hinge 40 between the solid-line position and the phantom-line position 40' of FIG. 2; it is preferred to employ a motor which constitutes a pneumatic cylinder and piston unit having a first portion or section 36 which is articulately connected to the respective arm 20 by a fulcrum 37, and a second portion or section 38 which is reciprocable relative to the portion or section 36 and is articulately connected to the hinge 40 by a fulcrum 39. The axes which are defined by the fulcra 37 and 39 are parallel to the axis of the pintle 41. The pintle 41 is located in the region of the front end portion 25 of the respective arm 20, the fulcrum 37 is adjacent to the nearest support member 14 of the skeleton frame of the upper section 12, and the fulcrum 39 is located between the fulcrum 37 and pintle 41 and is close to the pintle. The front end portion 25 of the arm 20 shown in FIG. 2 has a flat underside 29 which slopes downwardly from the customer side 15 toward the service side of the case including the sections 11 and 12 of the counter 10. The inclination of the underside 29 equals or approximates that of the support members 14.

The rear end portion 26 of the arm 20 which is shown in FIG. 2 is secured to the respective support member 14. To this end, the upper end portion 16 of the support member 14 carries an insert 17 having a recess 18 for the rear end portion 26 of the arm 20. One or more screws 19 (one indicated by a phantom line) are provided to separably connect the insert 17 to the arm 20 and preferably also to the respective support member 14. The panel 34 is a horizontal plate which can be made of a light-transmitting vitreous or plastic material and overlies the web 27 of the arm 20. As mentioned above, the skeleton frame of the upper section 12 of the case comprises several horizontal arms 20 so that the panel 34 rests on at least two coplanar webs 27. It is preferred to employ a panel 34 which extends all the way between the two ends of the counter 10.

Figure 7:
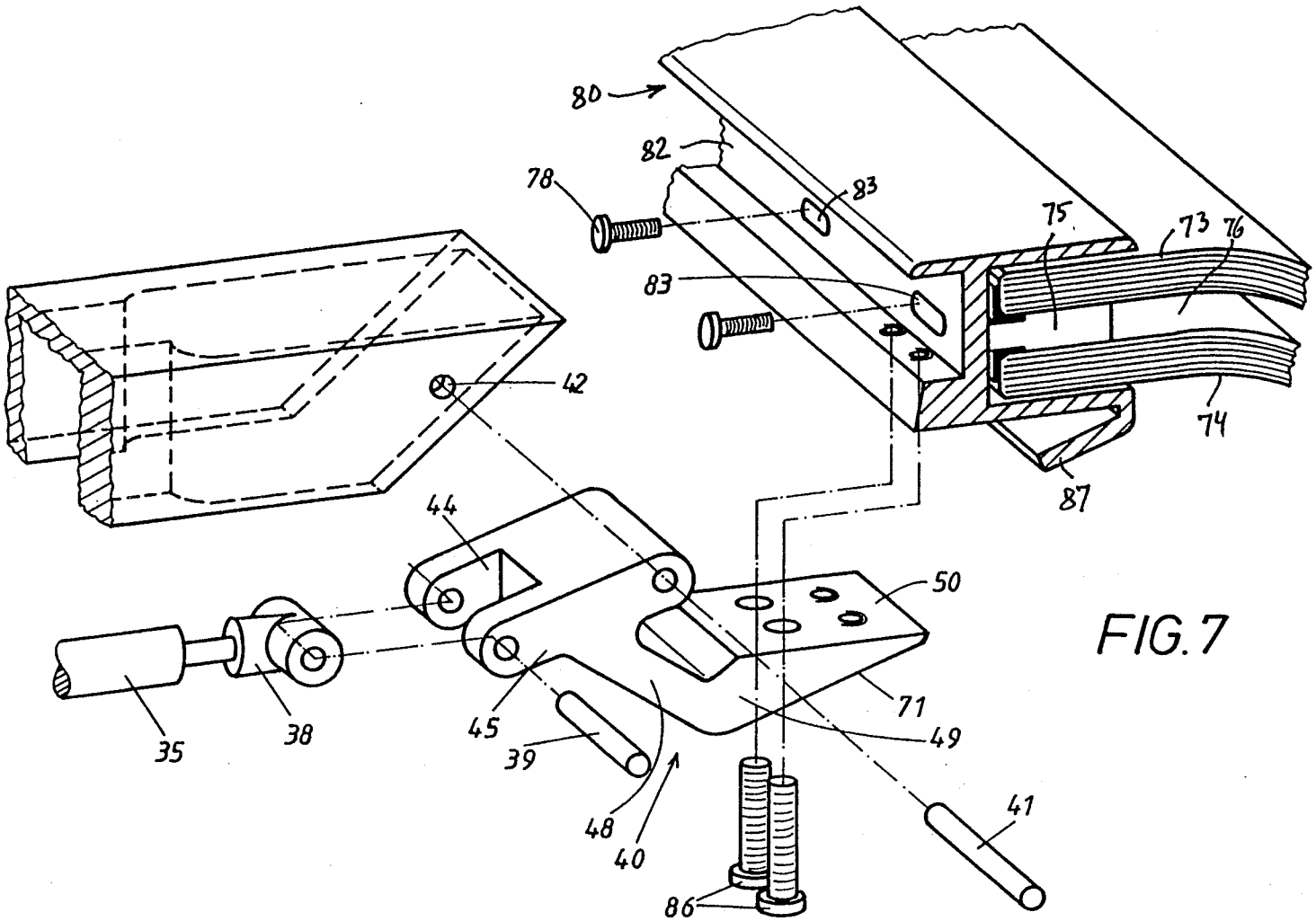
FIG. 7 is an exploded perspective view of the hinge and of portions of adjacent parts in the structure of FIGS and 4.

The motor 35 is disposed in part in the space 28 between the downwardly extending flanges 21, 22 of the arm 20. This motor is a pneumatic cylinder and piston unit whose rear portion 36 has a hook-shaped terminal which engages the fulcrum 37 (the latter extends between the reinforced portions 23 of the flanges 21 and 22 close to the insert 17) and whose front portion 38 has a hole for the fulcrum 39 which latter is also mounted in space 28 the flanges 21, 22 close to the pintle 41 and is installed in one end portion of a link 45 forming part of the hinge 40. As shown in FIG. 7, the foremost part of the motor portion 38 is T-shaped and fits into the space 44 between the two rearwardly extending legs of the link 45 of the hinge 40. The link 45 is rigid (preferably integral) with a distancing element 48 which makes therewith an obtuse angle 64 and whose end portion is rigid (preferably integral) with one end portion of an arcuate intermediate element 49 of the hinge 40. The other end portion of the intermediate element 49 is rigid (e.g., integral) with a bracket or platform 50 which, in turn, is rigidly connected to one elongated horizontal holding member or clamping rail 52 of the hinge 40. The latter further comprises a second elongated horizontal holding members or clamping rail 51, and the rails 51, 52 cooperate to reliably engage and hold between them the marginal portion 32 of the panel 30 so that the latter is compelled to share all angular movements of the two sections (45, 48, 49, 50 and 51, 52, 55) of the hinge 40 about the axis of the pintle 41 when the motor 35 is actuated to move the panel 30 between the solid-line position and the phantom-line position 30' of FIG. 2. The link 45 extends between and is pivotable about the axes which are defined by the pintle 41 and fulcrum 39, i.e., the motor 35 can pivot the link 45 about the axis of the pintle 41 whereby the link 45 pivots the other parts (48, 49, 50) of the first section as well as the second section 51, 52, 55 of the hinge 40. When the hinge 40 maintains the panel 30 in the solid-line position of FIG. 2, the dot-dash line 46 which connects the axes of the fulcrum 39 and pintle 41 slopes forwardly and upwardly so that it makes a relatively small acute angle with the plane of the web 27 of the arm 20. The line 46 crosses the downwardly and rearwardly sloping underside 29 of the front end portion 25 of the arm 20 in a region which is close to the tip of the front end portion 25. The line 46 and a line 47 which connects the axes of the fulcra 37, 39 for the motor 35 make a large obtuse angle as long as the panel 30 remains in the solid-line position of FIG. 2. The line 46 then slopes upwardly with reference to the line 47. When the internal chamber of the motor 35 receives a pressurized fluid medium (such as compressed air), it tends to move the fulcrum 39 motor 35 tends to increase its length) to thereby pivot the sections 45, 48–50 and 51, 52, 55 of the hinge 40 in a counterclockwise direction (as indicated in FIG. 2 by an arrow 43) and to thereby move the hinge 40 and the panel 30 to the respective phantom-line positions 40' and 30', namely to move the marginal portion 32 of the panel 30 from the level of the panel 34 to a level above the panel 34 and arm 20. The arrangement may be such that the motor 35 continuously tends to pivot the panel 30 to the phantom-line position 30' but the panel 30 remains in the solid-line position of FIG. 2 except when it is manually pivoted so that the person in charge of raising the panel 30 and affording access to the interior of the upper section 12 merely furnishes a relatively small or very small portion of the overall force which is needed to pivot the panel 30 to its second position. The motor 35 then maintains the panel 30 in the position 30' until and unless an attendant decides to pivot the panel 30 counter to the direction which is indicated by the arrow 43. Such pivoting can take place while the motor 35 is disconnected from the source of pressurized fluid medium or while the motor 35 remains connected with such source.

The upper clamping rail 51 of the hinge 40 has a downwardly extending portion which is adjacent the edge face 53 of the marginal portion 32 of the panel 30. Each of the clamping rails 51, 52 preferably extends the full length of the marginal portion 32, i.e., all the way between the ends of the counter 10. The means for separably securing the lower clamping rail 52 to the platform 50 includes several threaded fasteners 54 two of which can be seen in FIG. 2. The aforementioned downwardly extending portion of the upper clamping rail 51 forms one or more hooks which engage the adjacent shoulder or shoulders of the lower clamping rail 52 so that the two rails securely engage and flank the marginal portion 32 of the panel 30. Sealing material (e.g., elastic sealing strips) can be interposed between the clamping rails 51, 52 and the marginal portion 32. Such sealing material can define a substantially U-shaped pocket for the marginal portion 32 and can be made of rubber or another elastomeric material.

The dimensions of the distancing element 48 and arcuate intermediate element 49 of the hinge 40 are selected in such a way that the platform 50 is located in front of the arm 20 when the panel 30 assumes the solid-line position of FIG. 2. At such time, the platform 50 constitutes a forward extension of the arm 20. A rearwardly extending ledge-like portion 55 of the clamping rail 51 then overlies a substantially Z-shaped elastic sealing strip 60 which is provided between the panel 34 and the marginal portion 32 of the panel 30 and is partially recessed into a horizontal frame member 56 which is located in front of the panel 34 as well as into a substantially V-shaped lining 57 having a horizontal rim which overlies the upper side of the front end portion 25 of the arm 20, and a downwardly and rearwardly sloping part 59 which overlies a portion of the underside 29 of the end portion 25. The portion 55 of the clamping rail 51 cooperates with the sealing element 60 to completely seal a relatively narrow clearance between the panel 34 and arm 20 on the one hand and the section 51, 52, 55 of the hinge 40 and marginal portion 32 of the panel 30 on the other hand. The frame member 56 has a portion 58 which is adjacent the front edge face of the panel 34 and is integral with the horizontal rim of the lining 57. The rim of the lining 57 is recessed into the upper side of the front end portion 25 of the arm 20 and is overlapped by the adjacent foremost portion of the panel 34. The lining 57 reinforces the front end portion 25 of the arm 20 and serves as a carrier of the elastic sealing element 60 which latter cooperates with the portion 55 of the clamping rail 51 to seal the adjacent region of the internal space of the upper section 12 from the atmosphere. The portion 55 of the clamping rail 51 is located rearwardly of and is remote from the sealing element 60 when the panel 30 is caused to assume the second or raised position 30' of FIG. 2. When the panel 30 is returned to the solid-line position of FIG. 2, the clamping rails 51, 52 maintain the marginal portion 32 of the panel 30 at or close to the level of the panel 34, and the parts 34, 56, 51 and 32 then provide a practically uninterrupted surface extending from the upper side of the panel 34 to the outer side of the arcuate intermediate portion 33 of the panel 30. The internal space of the section 12 is then adequately sealed to facilitate and render less expensive the cooling of confined commodities (provided that a cooling is necessary) and to prevent contamination of such commodities as long as the panel 30 remains in the solid-line position of FIG. 2. As mentioned above, the motor 35 can be maintained in a condition such that it continuously tends to pivot the panel 30 and the parts 45, 48, 49, 50, 51, 52 and 55 of the hinge 40 in the direction of arrow 43 but can actually pivot the panel 30 to the position 30' only when assisted by an attendant. The motor 35 maintains the panel 30 in the position 30' as long as is necessary to remove the contents of the upper section, to insert commodities into the section 12 or to clean the inner side of the panel 30 and/or other parts surrounding the internal space of the section 12. Return movement of the panel 30 to the solid-line position of FIG. 2 is assisted by gravity as soon as the panel 30 reaches a predetermined intermediate position on its way away from the position 30'. The second positions of the hinge 40 and its parts 45, 48, 49 are shown in FIG. 2 by phantom lines and are denoted by similar reference characters each followed by a prime.

The intermediate element 49 of the hinge 40 has a concave inner side 61 which faces toward and is spaced apart from the pintle 41 and a convex outer side 62 which faces away from the pintle. The radius 63 of curvature of the inner side 61 is selected in such a way that the intermediate element 49 bypasses the lining 57 and the sealing element 60 on its way from the solid-line position to the phantom-line position 49' of FIG. 2 or vice versa. The centers of curvature of the inner and outer sides 61, 62 of the intermediate section 49 are located on or close to the axis of the pintle 41, and such centers of curvature preferably coincide so that the thickness of the element 49 is at least substantially constant all the way from the distancing element 48 to the platform 50. The just described configuration contributes to the eye-pleasing appearance of the intermediate element 49 and renders it possible to conceal or practically conceal this element when the panel 30 is held in the solid-line position of FIG. 2. When the panel 30 is caused to assume the position 30', the distancing element 48 is preferably closely or immediately adjacent and parallel to the underside 29 of the front end portion 25 of the arm 20. This contributes to compactness and lower cost of the hinge 40. The radius 63 of curvature of the inner side 61 of the arcuate intermediate section 49 of the hinge 40 (such radius equals or approximates the length of the distancing element 48) is selected with a view to ensure that the two sections of the hinge 40 can pivot about the axis of the pintle 41 in order to move the panel 30 between its first and second positions. The distancing element 48 is or can be flat (see FIG. 7) and is dimensioned with a view to reduce the bulk and cost of the hinge 40. The element 48 is preferably bounded by four flat surfaces, and it defines with the link 45 the aforementioned relatively large obtuse angle 64. The motor 35 is preferably provided with an internal stop (not shown) which serves to limit the extent of movability of the portion 38 in a direction away from the fulcrum 37 so that the panel 30 comes to a halt in an optimum second position 30' in which is does not tend to reassume the solid-line position under the action of gravity so that a relatively low pressure in the motor 35 suffices to maintain the panel in the position 30' as long as necessary. The line 47 is shifted to the position 47' when the motor 35 is fully extended, i.e., when the link 45 of the hinge 40 assumes the position 45' of FIG. 2.

The parts of the hinge 40 are preferably designed and mounted in such a way that the marginal portion 32 of the panel 30 is pivotable between a substantially horizontal first position at the level and in front of the panel 34 and a substantially vertical second position at a level above the panel 34.

Figure 6:
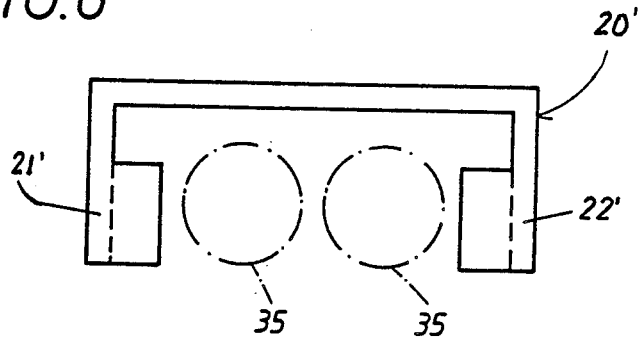
FIG. 6 is a similar view of a modified arm.

If the counter 10 is long or very long and its upper section 12 is tall or very tall, i.e., if the panel 30 is reasonably heavy or very heavy, the motor means which is used to assist in pivoting the panel 30 between its first and second positions can comprise a plurality of discrete fluid-operated cylinder and piston units. This is shown in FIG. 6 wherein the flanges 21', 22' of a relatively wide arm 20' flank two units 35 each of which has a first portion connected with the respective support member 14 (not shown in FIG. 6) and a second portion which is reciprocable relative to the first portion and is articulately connected to the front end portion of the arm 20' by a discrete fulcrum or by a common fulcrum (such as the fulcrum 39 of FIG. 2). The flanges 21, 22 or 21', 22' conceal the respective motor or motors so that such motor or motors can be seen only when the panel 30 is raised to assume the position 30'. The first portions of the fluid-operated cylinder and piston units which are shown in FIG. 6 can be connected to the respective support member 14 by a common fulcrum (such as the fulcrum 37 of FIG. 2) or by two discrete fulcra which preferably define a common pivot axis.

Figure 5:
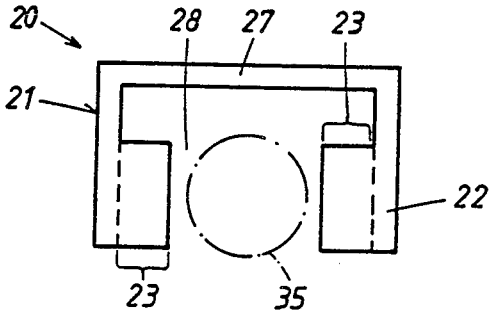
FIG. 5 is a schematic front elevational view of an arm which can be used in the display counter of the present invention.
Figure 3:
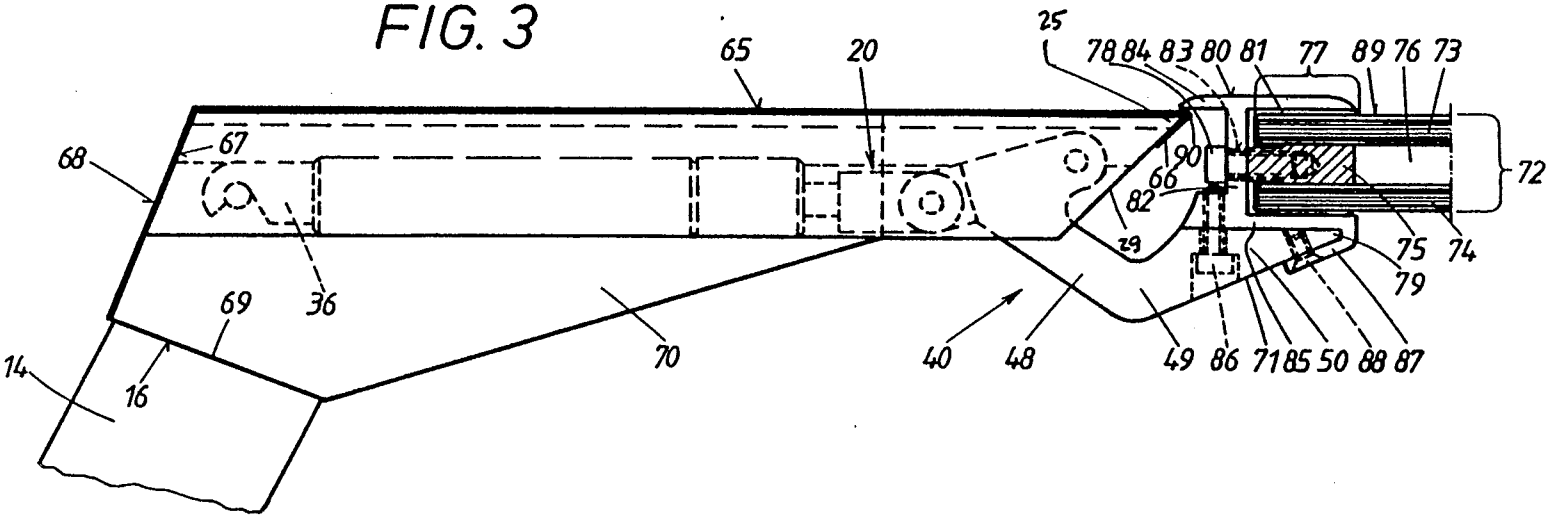
FIG. 3 is a similar partly elevational and partly sectional view of a modified upper section.
Figure 4:
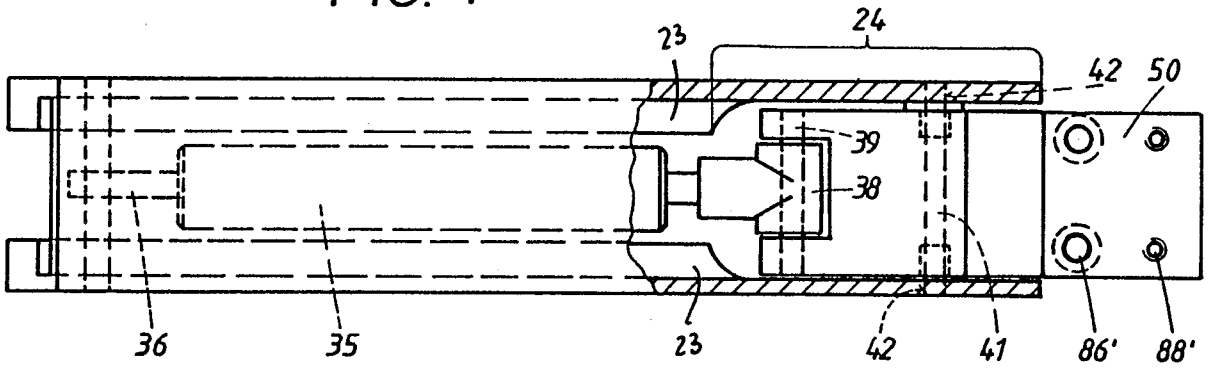
FIG. 4 a plan view of the structure which is shown in FIG. 3, with certain parts broken away and with the first panel omitted.

FIGS. 3, 4 and 7 show a portion of a modified design of the upper section of a case which embodies the invention. All such parts of this upper section which are identical with or clearly analogous to the corresponding parts of the upper section 12 of the counter 10 of FIGS. 1, 2 and 5 are denoted by similar reference characters. The panel 34 of the counter 10 of FIG. 2 is replaced with a sheet metal plate 65 having a downwardly sloping front portion 66 which overlies the upper part of the underside 29 of front end portion 25 of the arm 20. The rear portion 67 of the panel 65 is exactly or substantially parallel to the underside 29 and is overlapped by an upwardly extending metallic shroud 68 of the respective support member 14. The shroud 68 is integral with a further plate-like member 69 which overlies the upper end portion 16 of the support member 14. The panel 65 carries sheet metal sidewalls 70 which are bonded, screwed or welded thereto and flank the arm 20. Such sidewalls reinforce the panel 65 and conceal the major part of or the entire arm 20, together with the motor means 35 between the flanks of the arm. The arm 20 need not be directly connected to the respective support member 14, i.e., it can be secured only to the panel 65, particularly to its sidewalls 70. However, it is equally possible to connect the arm 20 to the support member 14, to the support member 14 and panel 65, or to another component part of the skeleton frame of the upper section of the case.

The hinge 40 which is shown in FIGS. 3 and 4 differs from the hinge 40 of FIGS. 2 and 7 in that the arcuate intermediate element 49 of FIG. 3 has a forward extension 71 which merges into the bracket or platform 50. The extension 71 reinforces both sections of the hinge 40. This is necessary because the panel 30 of FIG. 2 is replaced with a multiple-pane insulating window or panel 72 having two parallel panes 73, 74 and a metallic spacer 75 between the marginal portions 77 of the panes. The space 76 between the panes 73, 74 is or can be evacuated, and the spacer 75 can contain a supply of desiccant as is customary in so-called thermowindows. The marginal portions 77 of the panes 73, 74 are received in an elongated horizontal groove 81 of a rail 80 which extends or can extend all the way between the two ends of the counter embodying the structure of FIGS. 3 and 4. The substantially centrally located web 82 of the rail 80 has several slots 83 for the shanks of threaded fasteners 78 (see particularly FIG. 7) which are used to connect the rail with the spacer 75 of the panel 72. The spacer 75 has tapped bores for the shanks of the fasteners 78. Additional threaded fasteners 86 are provided to releasably connect the rail 80 to the platform 50. The rail 80 of FIGS. 3, 4 and 7 can be said to be a composite rail which has two spaced-apart rails flanking the marginal portions 77 of the panes 73, 74 and a web 82 which integrally connects the rails to each other in front of the marginal portions 77. It is clear that this H-shaped rail can be replaced with two discrete rails which are separably connected to each other and/or to the platform 50. The lower portion of the rail 80 has a downwardly and rearwardly sloping portion 87 which overlies and conceals the foremost portion 79 of the platform 50. The platform 50 has holes 86' and 88' for the shanks of the threaded fasteners 86 and 88. The fasteners 86 connect the extension 71 of the arcuate intermediate element 49 to the rail 80, and the fasteners 88 secure the portion 87 of the rail t the portion 79 of the platform 50. The upper part of the rail 80 has a portion 84 which corresponds to the portion 55 of the rail 51 in FIG. 2 and overlies the foremost portion 90 of the panel 65 to thus seal the interior of the hollow upper section of the case from the atmosphere when the panel 72 assumes the (first) position of FIG. 3. One or more elastic sealing elements can be installed between the portions 84 and 90 to further enhance the sealing action. The upper side 89 of the marginal portion 77 of the pane 73 is coplanar or substantially coplanar with the upper side of the panel 65 when the panel 72 is held in the position of FIG. 3.

It is clear that the panel 30 of FIGS. 1, 2 and 5 can be replaced with a multiple-pane panel of the type shown in FIG. 3, or that the panel 72 of FIG. 3 can be replaced with a simpler or even more complex panel. If the panel 72 is replaced with a lightweight panel, such as the panel 30 of FIG. 2, the relatively heavy and bulky rail 80 can be replaced with a simpler rail or with two rails corresponding to the rails 51, 52 of FIG. 2. Inversely, the rails 51, 52 of FIG. 2 can be replaced with a rail 80 if the panel 30 of FIG. 2 is replaced with a heavier (e.g., multiple-pane) panel.

Figure 9:
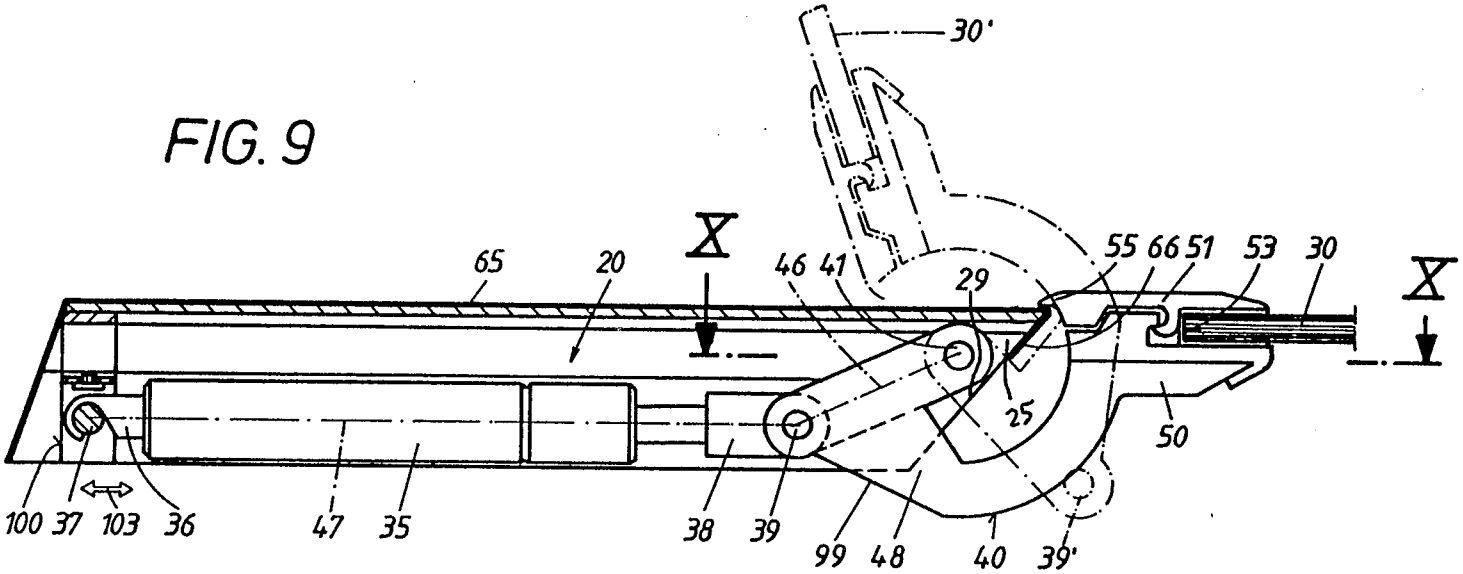
FIG. 9 is a vertical sectional view as seen in the direction of arrows from the line IX—IX of FIG. 8.
Figure 10:
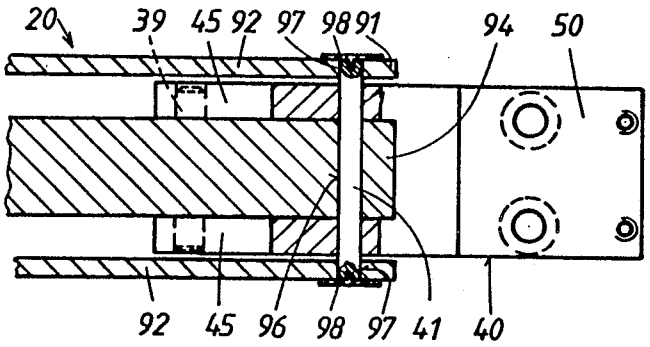
FIG. 10 is a fragmentary horizontal sectional view as seen in the direction of arrows from the line X—X of FIG. 9.

Referring to FIGS. 8 to 11, there is shown a portion of a further counter which embodies certain features of the counter of FIGS. 1–2 and certain features of the counter of FIGS. 3–4. The hinge 40 is similar to the hinge 40 of FIG. 2, and the panel 65 is similar to the panel 65 of FIGS. 3–4. The cross-section of the arm 20 has a substantially E-shaped outline with a horizontal web 93 and three downwardly extending flanges including two lateral flanges 92 and a median flange 94. The flanges 92 need not be reinforced in a manner as shown in FIG. 5 for the flanges 21, 22 because the median flange 94 contributes significantly to the strength of the arm 20 which is used in the counter of FIGS. 8 to 10. In other words, the cross section of each flange 92 can be constant from end to end. The arm 20 is a converted bar-shaped blank 91 of aluminum or an aluminum alloy. Removal of material between the lateral flanges 92 and the median flange 94 is desirable in order to reduce the weight of the arm 20 without unduly reducing its resistance to deformation and also to save the rather expensive material of the blank 91. The median flange 94 is undercut in the regions immediately adjacent the underside of the web 93 (note the grooves 95) in order to achieve additional savings in the material of the blank 91. The substantially E-shaped arm 20 exhibits additional advantages, particularly as concerns accurate guidance of the bifurcated link 45 (FIG. 11) of the hinge 40; the two legs of the link 45 flank the median flange 94 of the arm 20. The flange 94 has a transversely extending hole 96 for the pintle 41 of the hinge 40. In order to facilitate introduction of the pintle 41 into the hole 96, the lateral flanges 92 are formed with holes 97 which register with the hole 96 and the outer end portions of which are sealed by suitable caps 98 having male fastener elements which can be caused to snap into complementary female fastener elements in the respective end faces of the properly inserted pintle 41. As shown in FIG. 11, the two legs of the link 45 of the hinge 40 have holes which register with the hole 96 of the median flange 94 when the link 45 is properly mounted in the arm 20. The distancing element 48 is reinforced in that it assumes a trapeziform shape (as at 99) and tapers in a direction from the link 45 toward the arcuate intermediate element 49 of the hinge 40. The legs of the link 45 are further formed with holes 39' for the fulcrum 39 which articulately connects the hinge 40 with the respective portion 38 of the motor 35. When the panel 30 assumes its first position (which is shown in FIG. 9 by solid lines), the line 47 which connects the axes of the fulcra 37, 39 for the respective portions 36, 38 of the motor 35 is horizontal or nearly horizontal and makes a large obtuse angle with the line 46 which connects the axis of the fulcrum 39 with the axis of the pintle 41. The structure of FIGS. 8 to 11 is designed to take up large stresses, i.e., to properly support, guide and pivot a large, heavy and bulky panel 30. The line 47 intersects the downwardly and rearwardly sloping underside 29 of the front end portion 25 of the arm 20 close to the foremost portion of the panel 65 when the panel 30 dwells in the solid-line position of FIG. 9. This panel can be pivoted through an angle of at least 100° (note the phantom-line position 30' in FIG. 9) to thus ensure that gravity cannot initiate a return pivotal movement of the panel 30 to its solid-line position except if such movement is desired by an attendant.

The foremost portion of the panel 65 is overlapped by the portion 55 of the upper rail 51 of the hinge 40 as soon as the panel 30 reaches the solid-line position of FIG. 9 so that the parts 55, 65 then cooperate to seal the narrow clearance (if any) between the arm 20 and panel 65 on the one hand and the hinge 40 and panel 30 on the other hand. The upper side of that (marginal) portion of the panel 30 which is clamped between the rails 51, 52 is preferably flush or practically flush with the upper side of the panel 65 when the panel 30 is caused to dwell in the solid-line position of FIG. 9.

When the panel 30 is moved to the position 30' of FIG. 9 (this involves an angular movement of the two sections of the hinge 40 through more than 90° and preferably in excess of 100° ), the fulcrum 39 assumes the position 39', i.e., the line 47 then slopes forwardly and downwardly.

The fulcrum 37 for the rear end portion of the motor 35 is mounted in a bearing block 100 which is adjustably (shiftably) secured to the median flange 94 of the arm 20 in the region of the upper end portion of the respective support member 14 (not shown in FIGS. 8 to 11). The bearing block 100 is slidable forwardly toward and rearwardly away from the hinge 40 and can be arrested and reliably held in a selected position by a fastener 105 extending through a relatively thin web 106 forming an integral part of the bearing block 100 and being adjacent the underside of the median flange 94. This can be seen in FIG. 8 which further shows that the two upwardly extending portions 101 of the bearing block 100 have inwardly extending followers 102 slidable in the respective undercut grooves 95 of the median flange 94 of the arm 20. The fastener 105 has a head which is accessible in the space 107 between the lowermost ends of the portions 101. An advantage of the fastener 105 is that it can fix the bearing block 100 in any one of a practically infinite number of different positions relative to the arm 20 and hinge 40. The directions in which the bearing block 100 and its fulcrum 37 are adjustable are indicated in FIG. 9 by a double-headed arrow 103. The fulcrum 37 extends into two registering bores or holes 104 which are provided therefor in the portions 101 of the bearing block 100. The left-hand portion 36 of the motor 35 is flattened and forms a hook which engages the fulcrum 37 in the space between the portions 101. If desired, the underside of the median flange 94 can be provided with one, two or more shallow recesses for the tip of the shank of the fastener 105 so that the latter can fixedly hold the bearing block 100 in one, two or more predetermined positions each at a selected distance from the pintle 41. The adjustable or shiftable bearing block 100 enables an operator to select the force with which the motor 35 tends to pivot the panel 30 from the solid-line position to the phantom-line position 30' of FIG. 9. The head of the fastener 105 is slotted or has a socket to allow for engagement by a conventional torque transmitting tool, such as a screwdriver or the like.

An important advantage of the hinge 40 and of its rail or rails (such as 51 and 80) is that the hinge can automatically seal the clearance in front of the panel 34 or 65 when the panel 30 or 72 is held in its operative position. Moreover, the aforediscussed configuration of the hinge 40 renders it possible to ensure that a minimal manual effort is required to assist the motor or motors 35 in moving the panel 30 or 72 to its second or inoperative position. The motor or motors 35 can be readily installed in such a way that they are concealed but are highly effective in furnishing the major part of the force which is required to lift the front panel of the upper section 12 of the case. The feature that the upper side of the upper marginal portion of the panel 30 or 72 is flush or substantially flush with the upper side of the panel 34 or 65 is desirable and advantageous because this simplifies the dusting, washing and/or other cleaning operations at the exterior of the upper section 12. The overlapping portion 55 or 84 is lifted above and away from the foremost portions of the arm 20 and panel 34 or 65 as soon as the motor 35 is capable of pivoting the panel 30 or 72 from the operative to the raised position so that the hinge 40 does not interfere with any stage of movement of the panel 30 or 72 to its raised position.

Adequate sealing of the interior of the upper section 12 from the surrounding atmosphere is desirable and advantageous for a number of reasons including those already mentioned above (lower cost of maintaining the interior of the upper section 12 at a desired temperature and prevention of penetration of contaminants into the case) as well as on the additional ground that the odors developing in the interior of the case during storage of certain types of foodstuffs which contain or are treated with highly aromatic substances cannot fill the room and possibly affect the comfort of attendants and/or customers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A counter, particularly an article of furniture for temporary storage, cooling and simultaneous displaying of foodstuffs in supermarkets and like establishments, comprising a case having a front side which is faced by customers when the counter is set up in a supermarket or a like establishment and a service side opposite said front side, said case including a hollow portion and a plurality of fixedly mounted substantially horizontal arms extending forwardly from said service side toward said front side and having front end portions; a substantially horizontal first panel arranged to serve as a counter top, having a front portion and supported by said arms; a second panel having a marginal portion adjacent said arms; a hinge having a first section including holding members engaging said marginal portion of said second panel, at least one pintle defining a substantially horizontal pivot axis and provided on said arms, and an arcuate second section pivotable with said first section and with said second panel about said axis between a first position in which said first section is located in front of said arms and said second panel closes said hollow portion at the front side of said case beneath said arms, and a second position in which said second panel affords access to the interior of said hollow portion, said second section connecting said first section to said at least one pintle and being arranged to maintain said holding members substantially at the level and in front of the front end portions of said arms in the first position of said sections, said first section having a portion which is adjacent the front portion of said first panel in the first position of said sections; and motor means substantially parallel to said arms and operative to move said sections and said second panel between said positions, said motor means being connected to at least one of said arms and to at least one of said sections.

2. The counter of claim 1, wherein said second panel includes a panoramic window having two mutually inclined portions one of which is connected to said first section and the other of which is disposed at the front side of said case in the first position of said sections.

3. The counter of claim 1, wherein said motor means has an end portion adjacent said axis and further comprising a fulcrum connected to said second section and defining a pivot axis for the end portion of said motor means, said second section including a link which is pivotable about said axes, a distancing element rigid with said link, an arcuate intermediate element rigid with said distancing element, and connected with said first section.

4. The counter of claim 3, wherein said second section further includes a platform between said intermediate element and said first section, said marginal portion of said second panel being located substantially at the level of said first panel in the second position of said sections.

5. The counter of claim 1, further comprising a horizontal rim overlying the front end portions of said arms and immediately adjacent said, portion of said first section in the first position of said sections.

6. The counter of claim 1, wherein said rim forms part of said first panel.

7. The counter of claim 5, further comprising a horizontal frame member adjacent said first panel above the front end portions of said arms, said rim being rigid with said frame member.

8. The counter of claim 1, further comprising elastic sealing means provided at the front end portions of said arms and engaged by said portion of said first section in the first position of said sections.

9. The counter of claim 1, wherein said motor means includes a plurality of cylinder and piston units.

10. The counter of claim 9, wherein each of said arms has a substantially U-shaped profile and includes a web and two spaced-apart flanges rigid with said web, said units being located between said flanges.

11. A counter, particularly an article of furniture for temporary storage, cooling and simultaneous displaying of foodstuffs in supermarkets and like establishments, comprising a case having a front side which is faced by customers when the counter is set up in a supermarket or a like establishment and a service side opposite said front side, said case including a lower portion and a hollow upper portion and said upper portion including a substantially horizontal arm extending forwardly from said service side toward said front side and having a front end portion; a substantially horizontal first panel arranged to serve as a counter top and supported by said arm; a second panel; a hinge having a first section connected with said second panel, a pintle defining a substantially horizontal pivot axis and provided on said arm, and a second section pivotable with said first section and with said second panel about said axis between a first position in which said first section is located in front of said arm and said second panel closes said hollow upper portion at the front side of said case beneath said arm, and a second position in which said first section is located at a level above said arm and said second panel affords access to the interior of said hollow upper portion, one of said sections having a portion which is immediately adjacent the front end portion of said arm in the first position of said sections; a fluid-operated motor means operative to move said sections and said second panel between said positions; and elastic sealing means provided at the front end portion of said arm and engaged by said portion of said one section in the first position of said sections, said sealing means including a substantially Z-shaped sealing strip, said arm and said first panel having sockets for portions of said strip.

12. A counter, particularly an article of furniture for temporary storage, cooling and simultaneous displaying of foodstuffs in supermarkets and like establishments, comprising a case having a front side which is faced by customers when the counter is set up in a supermarket or a like establishment and a service side opposite said front side, said case including a lower portion and a hollow upper portion and said upper portion including a substantially horizontal arm extending forwardly from said service side toward said front side and having a front end portion; a substantially horizontal first panel arranged to serve as a counter top and supported by said arm; a second panel; a hinge having a first section connected with said second panel, a pintle defining a substantially horizontal pivot axis and provided on said arm, and a second section pivotable with said first section and with said section panel about said axis between a first position in which said first section is located in front of said arm and said second panel closes said hollow upper portion at the front side of said case beneath said arm, and a second position in which said first section is located at a level above said arm and said second panel affords access to the interior of said hollow upper portion, one of said sections having a portion which is immediately adjacent the front end portion of said arm in the first position of said sections, said arm having a substantially E-shaped cross-sectional outline and comprising a web and three flanges extending from said web and including a median flange, said pintle being provided in said median flange; and fluid-operated motor means operative to move said sections and said second panel between said positions.

13. The counter of claim 12, further comprising a bearing for said motor means, said bearing being mounted on said median flange.

* * * * *